US005823824A

United States Patent [19]

Mitamura et al.

[11] Patent Number: 5,823,824

[45] Date of Patent: Oct. 20, 1998

[54] SEALED CONNECTOR

[75] Inventors: Kenichi Mitamura, Fujisawa; Shinji Nakamoto, Hadano; Takayoshi Endo; Mitsuhiro Matsumoto, both of Haibara-gun, all of Japan

[73] Assignee: Yazaki Corporation, Tokyo, Japan

[21] Appl. No.: 899,302

[22] Filed: Jul. 24, 1997

Related U.S. Application Data

[63] Continuation of Ser. No. 399,410, Mar. 6, 1995, abandoned.

[30] Foreign Application Priority Data

Mar. 7, 1994 [JP] Japan ..... 6-035747

[51] Int. Cl.[6] ..... H01R 4/66

[52] U.S. Cl. ..... 439/585; 439/610

[58] Field of Search ..... 439/736, 741–751, 439/578–585, 610

[56] References Cited

U.S. PATENT DOCUMENTS

| | | | |
|---|---|---|---|
| 3,497,866 | 1/1967 | Patton, Jr. | 439/668 |
| 4,846,720 | 7/1989 | Song | 439/675 |
| 4,861,284 | 8/1989 | Pauzre et al. | 439/580 |
| 4,957,454 | 9/1990 | Schickida | 439/668 |
| 5,618,190 | 4/1997 | Masuda et al. | 439/610 |
| 5,645,450 | 7/1997 | Yamada et al. | 439/585 |

FOREIGN PATENT DOCUMENTS

| | | |
|---|---|---|
| 4-259770 | 9/1992 | Japan . |
| 4-135186 | 12/1992 | Japan . |
| 5-23458 | 3/1993 | Japan . |
| 5-25678 | 4/1993 | Japan . |
| 5-57778 | 7/1993 | Japan . |

*Primary Examiner*—Gary F. Paumen
*Assistant Examiner*—Tho D. Ta
*Attorney, Agent, or Firm*—Armstrong, Westerman, Hattori, McLeland & Naughton

[57] ABSTRACT

A sealed connector is provided which includes: an inner housing accommodating a terminal; an outer housing surrounding the inner housing; a metallic shield positioned between the inner housing and outer housing; a connecting portion connecting the inner housing and the outer housing to form a one-piece body; a shield insertion hole which is formed for communication of the interior of the sealed connector with a shield insertion space located between both inner and outer housing; and a connecting protrusion which is formed by notching at the pointed end of the metallic shield and which protrudes in the connector fitting direction through insertion of the metallic shield into the shield insertion space. The metallic shield includes a slit adjacent to the connecting protrusion and an engaging piece opposite to an engaging slot portion of the inner housing, wherein the bottom end portion of the slit contacts the connecting portion between the inner and outer housings. Each of the slits of the metallic shield accomodates the connecting protrusions of the other metallic shield which are alternately fitted into each other resulting in an elimination of the clearances when the male- and female-side sealed connectors are fitted into each other.

4 Claims, 7 Drawing Sheets

SEALED CONNECTOR

This application is a continuation of application Ser. No. 08/399,410 filed Mar. 6, 1995, now abandoned.

BACKGROUND OF THE INVENTION

1. Field of the Invention

The present invention generally relates to a sealed connector and more particularly, to a sealed connector in which an inner housing and an outer housing are integrally formed by being connected to each other with a connecting portion for improving the efficiency of assembling the sealed connector, etc.

2. Description of the Related Art

FIG. 8 is a cross-sectional view of a conventional male-side sealed connector as disclosed in the Japanese Utility Model Application Laid-Open No. 5-57778 (hereinafter "JP '778").

The male-side sealed connector 71 of JP '778 includes an outer housing 72 made of synthetic resin and an inner housing 73 made of insulating synthetic resin, wherein the inner housing 73 is engaged in the outer housing 72. The male-side sealed connector 71 of JP '778 also includes an electrically conductive cylindrical metallic shield 74 which is in contact with the outer periphery of the inner housing 73. The male-side sealed connector 71 of JP '778 also includes a shielded electric wire 76 which is pressure-joined to a caulking portion 75 located to the rear of the metallic shield 74. The male-side sealed connector 71 of JP '778 also includes a female terminal 77 which is connected to the shielded electric wire 76 accommodated in the inner housing 73.

A flexible engaging arm 78 of JP '778 is formed inwardly of the outer housing 72, and the rear end portion of the inner housing 73 is engaged with the flexible engaging arm 78. A braided shield of the shielded electric wire 76 is connected to the caulking portion 75 located to the rear of the metallic shield 74.

The male-side sealed connector 71 of JP '778 is connected to a female-side sealed connector (not illustrated). The female-side sealed connector has the same arrangement of inner and outer housings as the male-side sealed connector 71 for intercepting the noises existing in the internal and external portions of the sealed connector by using the metallic shield 74 to drain noises from the shielded electric wire 76 to the exterior of the sealed connector.

However, with respect to the above-described conventional structure of JP '778, there is the drawback that in order to intercept noises, the conventional sealed connector must have the three parts, namely, the outer housing 72, the inner housing 73, and the metallic shield 74 which increases both the cost of the parts and the cost of assembly.

FIG. 9 is the cross-sectional view of another conventional sealed connector in which a metallic shield 81 is molded by the synthetic resin within the connector housing 80 made of synthetic resin in one united body. According to the conventional structure shown in FIG. 9, the sealed connector can be assembled simply because it is not necessary to insert the metallic shield 81. However, there is the drawback that the strength of the sealed connector deteriorates at an extremely high temperature or an extremely low temperature since the heat-shrinking rate of the material of the connector housing 80 is different from the heat-shrinking rate of the material of the metallic shield 81.

SUMMARY OF THE INVENTION

In view of the foregoing, it is an object of the present invention to provide a sealed connector which can reduce both the number of parts constituting the sealed connector and the cost for assembling the sealed connector, while also preventing a deterioration in strength of the sealed connector caused by exposure to extremely high or low temperatures.

According to one aspect of the present invention, a sealed connector is provided which includes: an inner housing accommodating a terminal; an outer housing surrounding the inner housing; a metallic shield located between the inner housing and the outer housing, wherein the inner housing and the outer housing are integrally formed through the connecting portion; a shield insertion hole is formed between the inner housing and the outer housing to allow communication of the interior of the sealed connector with the shield insertion space between the outer housing and the inner housing formed in the circumferential direction adjacent to the connecting portion; and a connecting protrusion which protrudes from the insertion hole in the metallic shield insertion direction, the connecting protrusion being formed by notching at the pointed end of the metallic shield which is inserted into the shield insertion space.

According to a second aspect of the present invention, a sealed connector is provided which has a slit adjacent to the connecting protrusion of the metallic shield, and an engaging piece of the metallic shield which is opposite to an engaging concave slot portion of the inner housing, so that the bottom end portion of a slit of the metallic shield contacts the connecting portion between the inner and outer housings.

According to a third aspect of the present invention, a sealed connector is provided, wherein a shield insertion space of the male-side sealed connector and a shield insertion space of the female-side sealed connector are shifted with respect to each other by a phase angle in the circumferential direction. Thus, the connecting protrusion of the metallic shield of the female-side sealed connector is alternately fitted into the slit of the metallic shield of the male-side sealed connector.

As stated above, the sealed connector according to the present invention, wherein the metallic shield is inserted and installed into the shield insertion space between the inner housing and the outer housing, and the connecting protrusion in the pointed end portion of the metallic shield protrudes in the direction that the metallic shield is inserted into the shield insertion space. The connecting protrusion of the metallic shield of the male-side sealed connector securely contacts the connecting protrusion of the metallic shield of the female-side sealed connector in such a way that a revolution of the connecting protrusion is prevented by the connecting portion. A proximal end portion of the slit of the metallic shield is brought into contact with the connecting portion in the direction of the insertion of the metallic shield into the shield insertion space when the male-side and female-side connectors are connected to each other. The engaging piece of the metallic shield prevents the metallic shield from slipping off of the inner housing by the engaging piece engaging the engaging slot portion of the inner housing. Each of the slits of the metallic shield receives the connecting protrusion of the metallic shield of the other connector resulting in an elimination the clearances previously left by the unfilled slits.

The above and further objects and novel features of the invention will be more fully understood from the following detailed description when the same is read in connection with the accompanying drawing figures. It should be expressly understood, however, that the drawing figures are for the purpose of illustration only and are not intended as a definition of the limits of the present invention.

BRIEF DESCRIPTION OF THE DRAWING FIGURES

DETAILED DESCRIPTION OF THE PREFERRED EMBODIMENTS

A preferred embodiment of the present invention will now be described in detail referring to the accompanying drawing figures.

FIGS. 1–7 show a male-side sealed connector and a female-side sealed connector embodying one aspect of the present invention.

Figure 1:
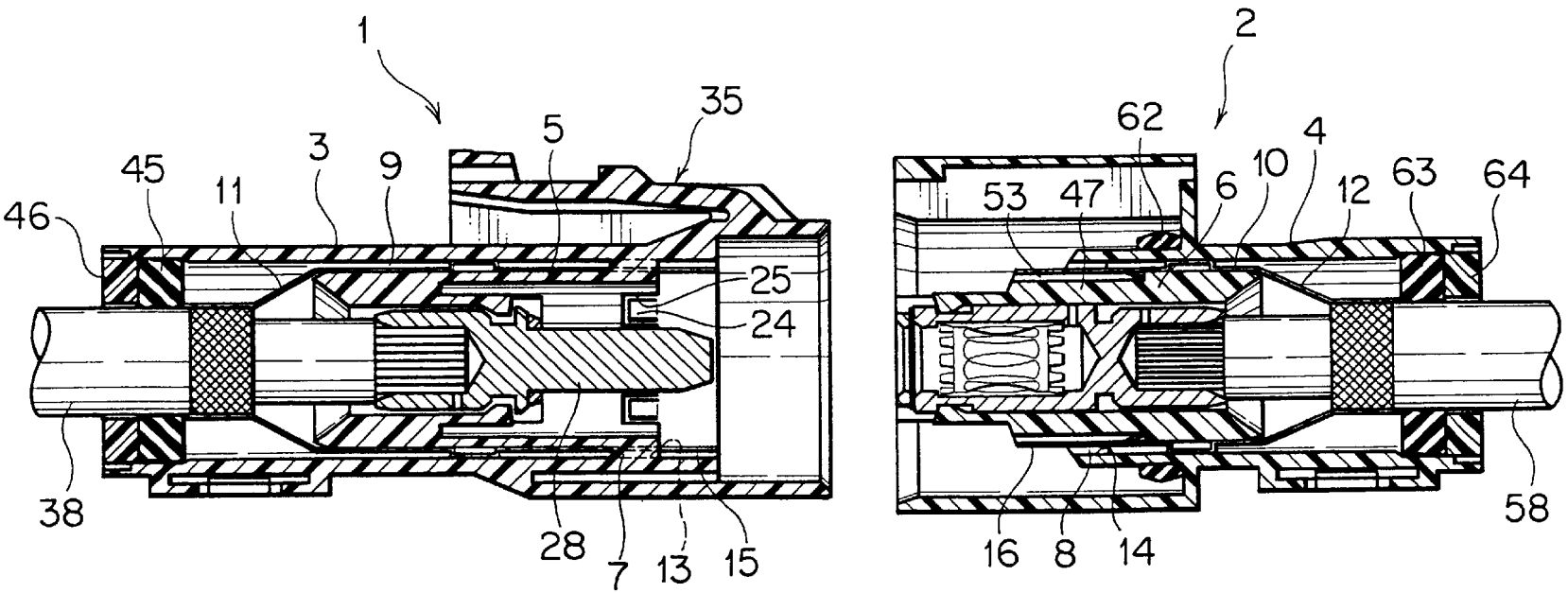
FIG. 1 is a schematic longitudinal cross-sectional view showing a sealed connector according to the present invention.

Referring to FIG. 1, a male-side sealed connector 1 and a female-side sealed connector 2 are shown. The male-side sealed connector 1 has outer housing 3 and inner housing 4 which are connected to each other by the connecting portion 7. The female-side sealed connector 2 has outer housing 4 and inner housing 6 which are connected to each other by the connecting portion 8. The male-side sealed connector 1 has a shield insertion space 9 formed between outer housing 3 and inner housing 5. A metallic shield 11 is inserted into the shield insertion space 9 of the male-side sealed connector 1. The female-side sealed connector 2 has a shield insertion space 10 formed between outer housing 4 and inner housing 6. A metallic shield 12 is inserted into the shield insertion space 10 of the female-side sealed connector 2.

Figure 4:
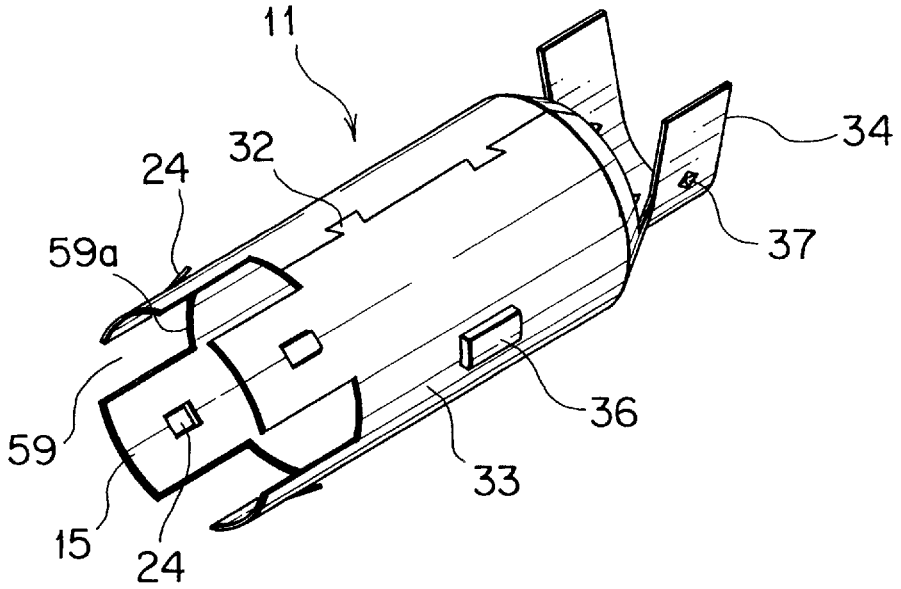
FIG. 4 is a schematic perspective view showing a metallic shield according to the present invention.

Referring to FIG. 4, a metallic shield 11 of the male-side sealed connector 1 is shown. The metallic shield 12 of the female-side sealed connector 2 is not separately illustrated in the drawings, but is the same as the metallic shield 11 of the male side sealed connector 1. Each of the metallic shields 11 and 12 has a connecting protrusion 15 and 16, respectively. The connecting protrusions 15 and 16 are formed at the second end of metallic shields 11 and 12, respectively, by notching. The connecting protrusions 15 and 16 protrude in the connector fitting direction in a way that the connecting protrusions 15 and 16 are inserted into the shield insertion spaces 9 and 10, respectively, toward the circumferential direction adjacent to the connecting portions 7 and 8, respectively. Each of the connecting protrusions 15 and 16 permits slip fitting and insertion alternately.

Figure 2:
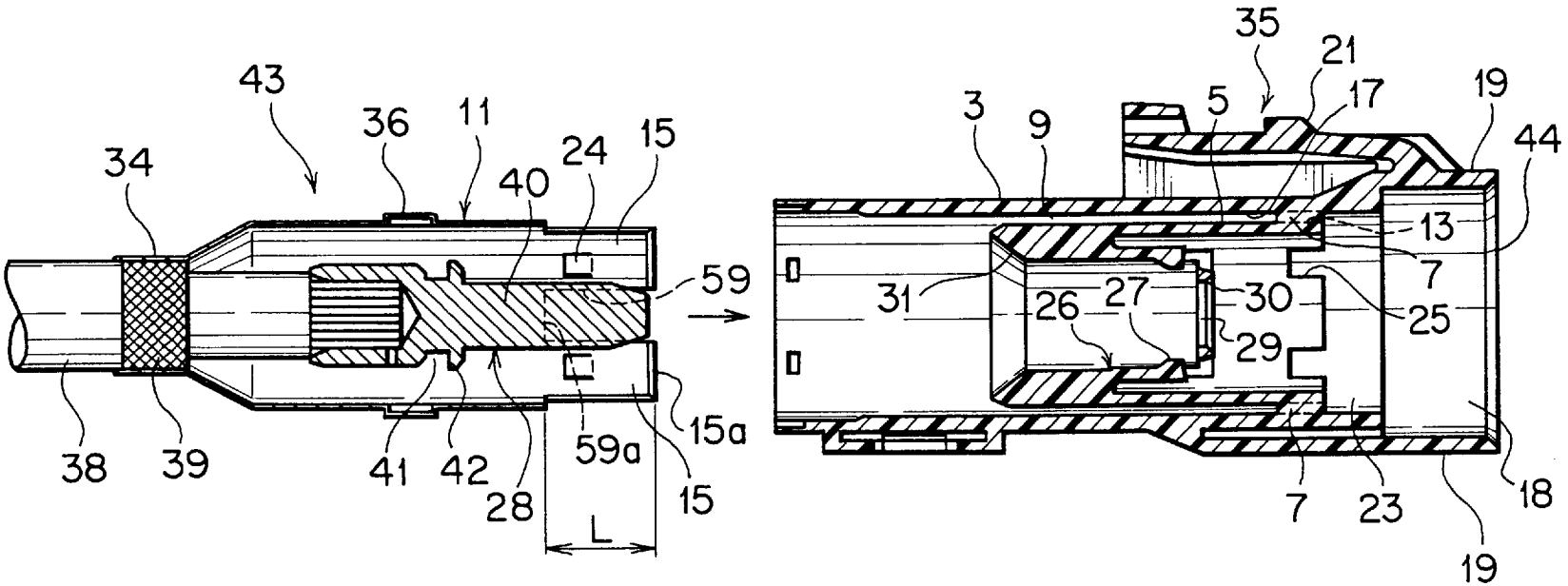
FIG. 2 is a schematic longitudinal cross-sectional view showing an assembling condition of a male-side sealed connector according to the present invention.
Figure 3:
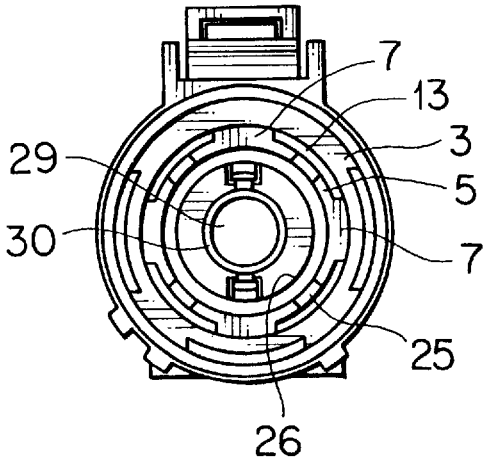
FIG. 3 is a schematic front elevational view showing the inner and outer housings of the male-side sealed connector according to the present invention.

As is shown in FIGS. 2 and 3, the male-side sealed connector 1 has four connecting portions 7 which protrude outwardly from the outer wall of the inner housing 5 to the inner wall 17 of the outer housing 3 in the circumferential direction at the front end of the male-side sealed connector 1. The inner housing 5 is formed into a cylindrical shape with an elongated configuration from the end portion of the inner periphery of the connecting portion 7 to the opposite end of the inner housing 5 of the male-side sealed connector for coaxial alignment and integral formation. An insertion hole 13 has a circular arc-shaped configuration in a direction towards the connecting portions 7 and 7 adjacent thereto. The insertion hole 13 is twice as wide as the connecting portion 7 in the circumferential direction of the inner housing 5. The insertion hole 13 is divided into quarters in the circumferential direction of the outer housing 3 and is formed for communication of the interior of the male-side sealed connector 1 into the annular shield insertion space 9 located between the outer housing 3 and the inner housing 5. The annular metallic shield 11 is inserted into the shield insertion space 9. The front end of the outer housing 3 of the male-side sealed connector 1 contacts a hood portion 19 which surrounds an aperture-side enlarged diameter part 18.

Figure 5:
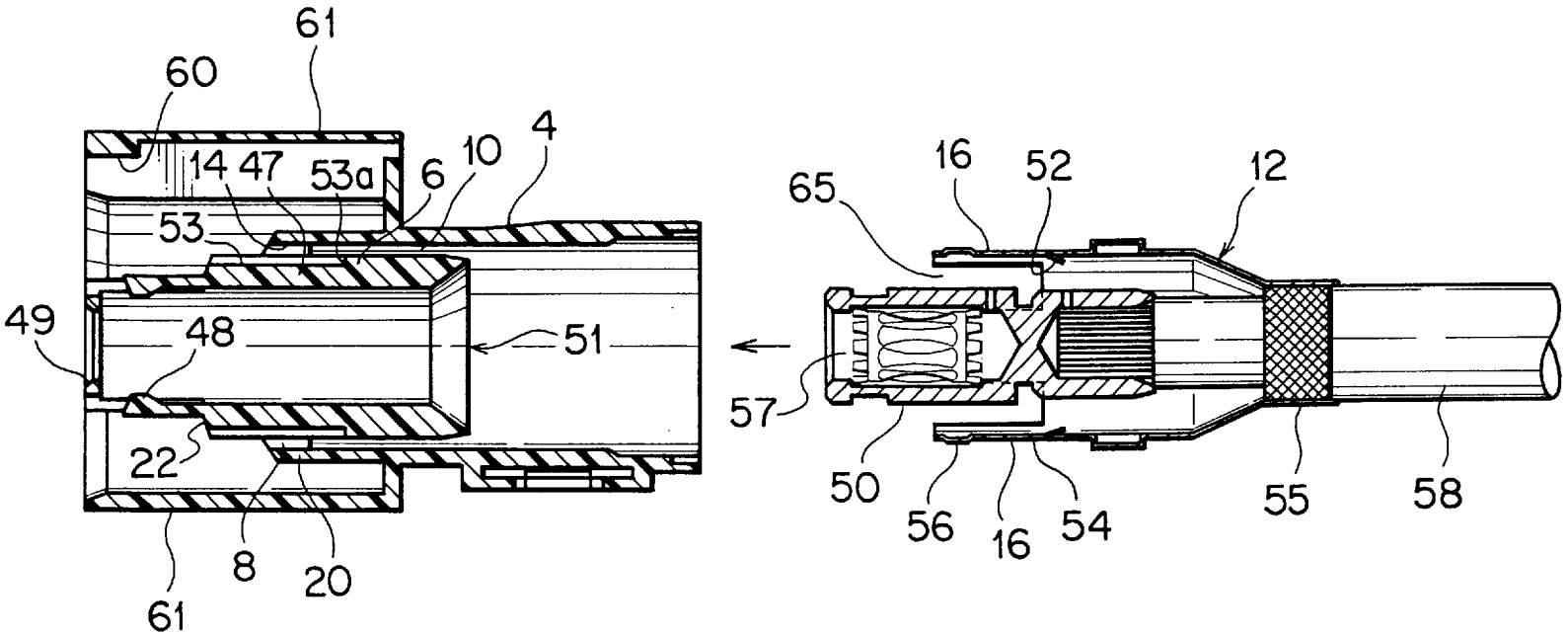
FIG. 5 is a schematic longitudinal cross-sectional view showing a disassembled state of a female-side sealed connector according to the present invention.
Figure 7:
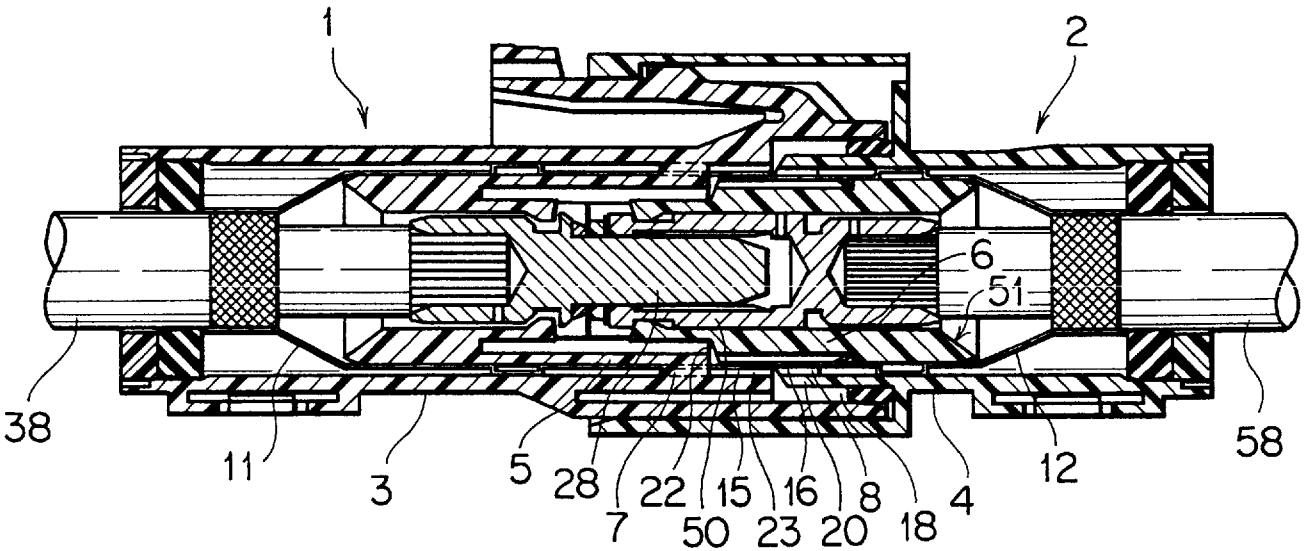
FIG. 7 is a schematic longitudinal cross-sectional view showing the male-side sealed connector inserted into and connected to the female-side sealed connector according to the present invention.
Figure 8:
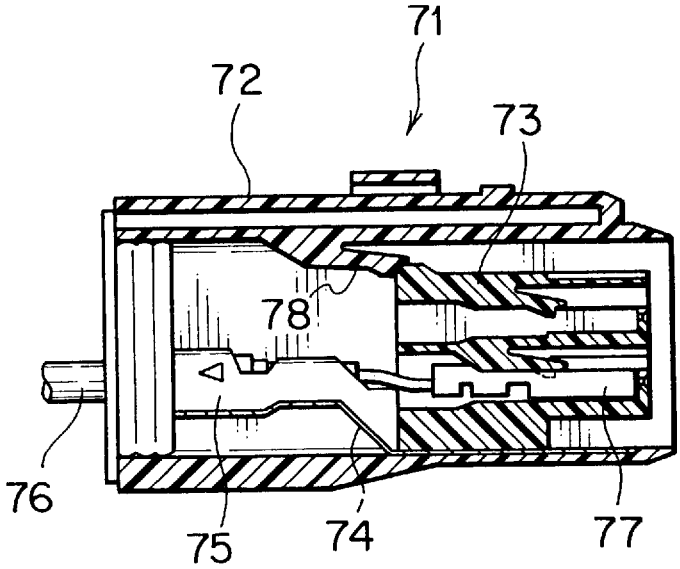
FIG. 8 PRIOR ART
FIG. 8 is a schematic longitudinal cross-sectional view of a conventional sealed connector.
Figure 9:
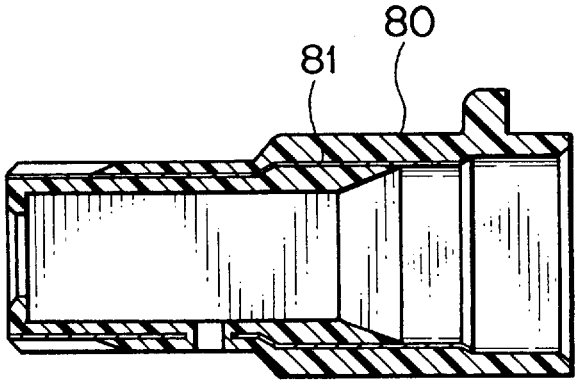
FIG. 9 PRIOR ART
FIG. 9 is a schematic longitudinal cross-sectional view of the another conventional sealed connector.

Referring to FIGS. 5 and 7 of the drawing figures, the front end portion 20 of the outer housing 4 of the female-side sealed connector 2 faces opposite the front end of the male-side sealed connector 1, before the front end of the male-side sealed connector 1 is inserted into the front end of the female-side sealed connector 2 so that the aperture-side enlarged diameter part 18 of the male-side sealed connector 1 slidingly receives the annular forward end portion 49 of the female-side sealed connector 2. The hood portion 19 of the male-side sealed connector 1 is provided with a flexible engaging arm 21 opposite to the female-side sealed connector 2. An inside enlarged diameter portion 23 of the male-side sealed connector 1 accommodates both the connecting protrusion 15 of the metallic shield 11 and an intermediate projection 22 of the inner housing 6 of the female-side sealed connector 2 (referring to FIGS. 5 and 7). The inside enlarged diameter portion 23 of the male-side sealed connector 1 is formed between the aperture side enlarged diameter part 18 and the forward end portion of the connecting portion 7 (i.e., the forward end portion of the inner housing 5).

In the forward end portion of the inner housing 5 of the male-side sealed connector 1 with respect to the inside enlarged diameter portion 23, a rectangular-shaped engaging slot portion 25 is formed by notching with an evenly spaced arrangement in the circumferential direction. The rectangular-shaped engaging slot portion 25 is formed opposite to an engaging piece 24 of the metallic shield 11 of the male-side sealed connector 1 so that the engaging piece 24 may engage the rectangular-shaped engaging slot portion 25. As shown in FIG. 3, the engaging concave slot portion 25 continuously communicates with the inside of the insertion hole 13 having the circular arc-shaped configuration. On the inside of the inner housing 5 of the male-side sealed connector 1, a cylindrical terminal-accommodation part 26 is coaxially formed with respect to the inner housing 5 toward the forward direction from the backward direction. A pair of terminal engaging lances 27 are formed forwardly of the terminal-accommodation part 26 which is directed inwardly thereof. At the forward tip of the terminal-accommodation part 26, an annular portion 30, which is coaxially formed with the inner housing 5 of the male-side sealed connector 1, has an insertion hole 29 to the male terminal 28 positioned on the inside of the metallic shield 11.

At the rearward tip of the terminal-accommodation part 26, an inclined guide 31 is formed and is directed inwardly toward the male terminal 28.

The metallic shield 11, as shown in FIG. 4, includes a cylindrical portion 33 wherein a conductive metal plate is bent into a cylindrical configuration and then joined together by a dovetail joint 32 at both ends thereof. Four connecting protrusions 15 protrude from the tip of the cylindrical portion 33 so as to be integrally formed therewith and in an evenly spaced arrangement with respect to the circumferential direction. In other words, the connecting protrusions 15 are of such a configuration that the connecting protrusions 15 have a cross-sectional circular arc. An electric wire caulking portion 34 is formed and arranged at the rearward tip of the cylindrical portion 33. The connecting protrusions 15 are integrally formed in the manner that the rectangular part, which is a little wider than the width of the connecting portion 7, is cut away from the conductive metal plate so as to form four slits 59. Furthermore, the connecting protrusions 15 are bent into a cylindrical configuration having the same radius of curvature as the cylindrical portion 33 of the metallic shield 11. On the outer periphery of the intermediate part of the cylindrical portion 33 of the metallic shield 11, a box-shaped protrusion 36 is formed. The box-shaped protrusiong 36 fits into the shield insertion space 9 of the male connector housing 35 (i.e., the outer housing 3 and the inner housing 5 connected by the connecting portion 7) to keep the metallic shield 11 in place around the inner housing 5, after the metallic shield 11 has been inserted into the shield insertion space 9 of the male-side sealed connector 1. An engaging piece 24 is located in the proximal portion of each of the connecting protrusions 15. The engaging pieces 24 each have a spring-like property. The spring-like property is due to the formation of the engaging pieces 24 by cutting three sides of a rectangular shape from each of the connecting protrusions 15 and then raising the rectangular shape at an angle to the cylindrical periphery of the metallic shield 11 so that the rectangular shape is bent at the fourth uncut side.

An electric wire caulking portion 34 is located at the front end of the metallic shield 11. A wedge-shaped projection 37 projects radially inwardly from the outer periphery of the electric wire caulking portion 34. The wedge-shaped projection is for fixing a cable inside of the metallic shield 11. As shown in FIG. 2, at the electric wire caulking portion 34, a braided shield section 39 of the shielded electric wire 38 is connected by caulking. A male terminal 28 has a pin-shaped contact portion 40 and the male terminal 28 is connected to the shielded electric wire 38 by contact bonding. An engaging groove 41, corresponding to the engaging lance 27 on the side of the male connector housing 35, and a contact collar portion 42, corresponding to the annular portion 30, are formed at the root part of the male terminal 28. The male terminal 28 is positioned at the approximate center of the sealed connector and inwardly of the metallic shield 11. A pointed end of the pin-shaped contact portion 40 is positioned a short distance to the rear of a tip 15*a* of the connecting protrusion 15. The tip 15*a* of the connecting protrusion 15 is chamfered.

A shield assembly 43, which includes the male terminal 28 and the metallic shield 11, is inserted into the male connector housing 35. The male terminal 28 is inserted smoothly into the terminal-accommodation part 26 along a tapered guide 31. The pin-shaped contact portion 40 protrudes from the annular portion 30. The collar portion 42 is stopped in a state where it contacts the annular portion 30 and the engaging groove 41 is engaged with the engaging lance 27.

The metallic shield 11 is inserted into the shield insertion space 9 between the inner housing 5 and the outer housing 3 of the male-side sealed connector 1. The connecting protrusions 15, located in the pointed end of the metallic shield 11, penetrate into the inside enlarged diameter portion 23 through the circular arc-shaped insertion hole 13 of the connecting portions 7 and 7 toward the housing aperture 44. The engaging piece 24 is engaged with the engaging concave portion 25, resulting in the engaging piece 24 being prevented from coming off of the engaging concave slot portion 25 in a direction toward the rear of the metallic shield 11. The engaging piece 24 passes through the insertion hole 13 and is deformed thereby. Then, after restoration from a deformed state, the engaging piece 24 can be engaged with the engaging concave slot portion 25. A proximal end portion 59*a* of the slit 59 (i.e., notched part at the pointed end of the metallic shield 11) adjacent to the connecting protrusion 15 comes into contact with the connecting portion 7 and the slit 59 of the metallic shield 11 engages the connecting portion 7 in the direction in which the metallic shield 11 is inserted into the shield insertion space 9 between the inner and outer housings 5 and 3 of the male-side sealed connector 1. Length L (cf. FIG. 2) and width W dimensions of the slit 59 are set so that the connecting protrusion 15 sufficiently comes into contact with the slit of the metallic shield 12 of the female-side sealed connector 2 and the connecting portion 7 maintains sufficient strength.

The box-shaped protrusion 36 on the outer periphery of the metallic shield 11 prevents loosening or deflection of the metallic shield 11 by virtue of contacting the outer housing 3 after the metallic shield 11 is inserted into the shield insertion space 9. Some openings (not illustrated) exist between the inner housing 5 and the metallic shield 11 in the direction of the diameter of the metallic shield 11. Lastly, a rubber stopper 45 and a rear holder 46 are inserted between the shielded electric wire 38 and the outer housing 3 of the male-side sealed connector 1.

Figure 6:
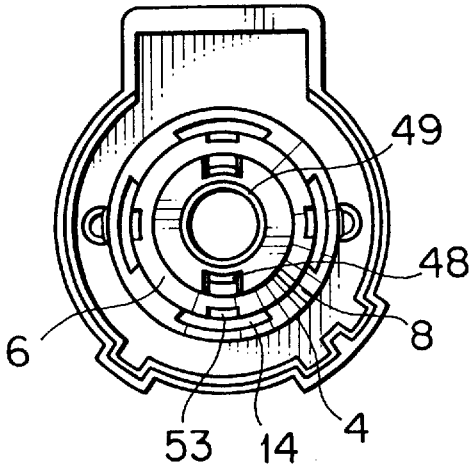
FIG. 6 is a schematic front elevational view showing the inner and outer housings of the female-side sealed connector according to the present invention.

As shown in FIG. 7, the male-side sealed connector 1 is connected to the female-side sealed connector 2. As shown in FIGS. 1, 5 and 6, the cylindrical outer housing 4 and the inner housing 6 of the female-side sealed connector 2 are integrally formed by the connecting portion 8 similarly to the connecting portion 7 of the male-side sealed connector 1. As shown in FIG. 6, the connecting portion 8 of the female-side sealed connector 2 and the insertion hole 14 adjacent thereto are shifted in phase only about 45° as compared with the connecting portion 7 of the male-side sealed connector 1 and the insertion hole 31. Thus, the female-side sealed connector 2 alternately contacts the connecting protrusion 16 for metallic shield 12 of the female-side sealed connector 2 and the connecting protrusion 15 for the metallic shield 11 of the male-side sealed connector 1. For the sake of this, since each of the slits 59 and 65 of the male- and female-side sealed connectors 1 and 2, respectively, receives the connecting protrusions 15 and 16 of the male- and female-side sealed connectors 1 and 2, respectively, when the metallic shields 11 and 12 of the male- and female-side sealed connectors 1 and 2, respectively, are fits into each other, good shielding is performed without entrance and leakage of noises.

The inner housing 6, of the female-side sealed connector 2, constitutes a terminal accommodation part 51 for the female terminal 50 including a thick-walled annular portion 47. The front half of the thick-walled annular portion 47 is pushed out forwardly from the outer housing 4 of the female-side sealed connector 2. An engaging lance 48 integrally protrudes forwardly from the forward end of the thick-walled annular portion 47 and an annular forward end portion 49. An engaging groove 53, which is formed by notching, extends over the intermediate portion from the forward end of the metallic shield 12 in correspondence to the engaging piece 52 of the metallic shield 12 in the periphery of the thick-walled annular portion 47, wherein the engaging piece 52 engages the rearward end step-shaped portion 53*a* of the engaging groove 53. The connecting portion 8, of the female-side sealed connector 2, is formed on the inside of the end of the forehead 20 of the outer housing 4 in front from the rearward end step-shaped portion 53*a*. The engaging groove 53 is formed for communication of the interior of the sealed connector and the insertion hole 14.

The metallic shield 12, of the female-side sealed connector 2, is joined to the periphery of the thick-walled annular portion 47. The metallic shield 12, of the female-side sealed connector 2, includes a cylindrical part 54 having a diameter which is a little smaller than the diameter of the metallic shield 11 of the male-side sealed connector 1. The metallic shield 12 also includes a connecting protrusion 16, at the pointed end of the metallic shield 12 of the female-side sealed connector 2, and an electric wire caulking portion 55. The engaging piece 52, which confronts the engaging groove 53, is inwardly formed by cutting, and raising the cut portion on the inside of the cylindrical portion 54. The connecting protrusion 16 of the metallic shield 12 of the female-side sealed connector 2 has a contacting convex surface 56 directed outwardly. The contacting convex surface 56 also slidably comes into contact with the opposite of the inside wall of the connecting protrusion 15 on the metallic shield 11 of the male-side sealed connector 1.

As shown in FIG. 5, the shielded electric wire 58 is fixedly connected to the caulking portion 55 when the female terminal 50, which has a connecting hole 57 opposite the male terminal 28, is ejected forwardly from the tip of the connecting protrusion 16 of the metallic shield 12 of the female-side sealed connector 2. The female terminal 50 is engaged within the terminal accommodation part 51. The metallic shield 12, of the female-side sealed connector 2, is inserted into the shield insertion space 10 between the outer housing 4 and the inner housing 6. The connecting protrusion 16, of the female-side sealed connector 2, projects forwardly from the insertion hole 14. As shown in FIG. 1, the connecting protrusion 16, of the female-side sealed connector 2, contacts the thick-walled annular portion 47, except for the engaging groove 53 of the inner housing 6. Some openings (not illustrated) exist between the inner housing 6 and the metallic shield 12, of the female-side sealed connector 2, in the direction of the diameter of both the inner housing 6 and the metallic shield 12. The hood portion 61, which is provided with the engaging protrusion 60 opposite the flexible engaging arm 21, is continuously formed at the exterior of the outer housing 4 of the female-side sealed connector 2. A waterproof packing 62 (cf. FIG. 2) is inserted on the bottom of the hood portion 61 of the outer housing 4 of the female-side sealed connector 2. A rubber stopper 63 and a rear holder 64 are inserted and then, as shown in FIG. 7, the male-side sealed connector 1 and the female-side sealed connecter 2 are connected to each other by the front of the male-side sealed connector 1 being inserted into the female-side sealed connector 2.

The male-terminal 28 and the female-terminal 50 are connected to each other by the front half of the terminal-accommodation part 51 of the female-side sealed connector 2 being inserted into the inside of the inner housing 5 of the male-side sealed connector 1. Thus, the connecting protrusions 16 of the metallic shield 12 of the female-side sealed connector 2 enter into the inside enlarged diameter portion 23 of the male-side sealed connector 1 and electrically contact the inside wall of the connecting protrusion 15 of the metallic shield 11 of the male-side sealed connector 1 by sliding insertion thereinto. The arrangement can alternate between the connecting protrusions 15 and 16 of the male- and female-side sealed connectors 1 and 2, respectively, being closely fitted into the slits 59 and 65 of the male- and female-side sealed connectors 1 and 2, respectively. The close fitting of the connecting protrusions 15 and 16 of the male- and female-side sealed connectors 1 and 2, respectively, within the slits 59 and 65 of the male- and female-side sealed connectors 1 and 2, respectively, to perform good electrical shielding.

It will be appreciated from the foregoing description that, according to the present invention, the outer housing and the inner housing are integrally formed by connection at the connecting protrusion. Therefore, time for assembling separately can be omitted, work efficiency of assembling can be improved, and parts cost can be reduced. Since the metallic shield and the housing are not integrally formed but are separately assembled, a difference in the rates of heat shrinking in the materials of the metallic shield and the housing is absorbed into the openings therebetween and accordingly, the strength of the sealed connector is ensured under extremely high and low temperatures.

Further, the metallic shield is stably located in the circumferential direction because the connecting protrusion of the metallic shield is inserted into the shield insertion space between the inner and outer housings. The slits in the bottom end portions of the metallic shield open in the direction the shield is inserted and come into contact with the connecting protrusion. At the same time, since the engaging piece of the metallic shield is engaged with the engaging slot portion of the inner housing, the assembling of the metallic shield within the sealed connector can be performed simply and securely and can result in an improvement in work efficiency of assembling the sealed connector and obtaining sure shield connection at both the connecting protrusions of the male- and female-side sealed connectors. The connecting protrusions of the metallic shield of the female-side sealed connector are alternately fitted in the slits opposite the connecting protrusion of the metallic shield of the male-side sealed connector. Since the slits of the metallic shield receive the connecting protrusions which are closely fitted into each other, good electrical shielding is performed without entrance and leakage of noises.

What is claimed is:

1. A sealed connector for sealing shield electric wires therewithin using sealing means, said sealed connector comprising:

a male connector portion comprising:

an elongated annular male connector housing including an inner housing and an outer housing, wherein said inner and outer housings of said male connector portion are both of an elongated annular shape and wherein said inner and outer housings of said male connector housing are connected to each other by a plurality of connecting portions evenly spaced in a circumferential direction between both said inner and outer housings of said male connector housing so that said inner housing, said outer housing and said connecting portion of said male connector housing form an integral one-piece body;

an elongated annular male-side metallic shield for draining noises from a portion of said shielded electric wire housed within said male connector housing, wherein said male-side metallic shield has first and second ends;

a male-side shield insertion space for housing said male-side metallic shield therewithin, wherein said male-side shield insertion space is located between said inner and outer housings of said male connector housing, and wherein said male-side shield insertion space surrounds said plurality of connecting portions;

wherein said male-side metallic shield includes a plurality of connecting protrusions, each of said connecting protrusions being formed by notching a plurality of slits in said first end of said male-side metallic shield so that said protrusions alternate with said slits in a circumferential direction of said male-side metallic shield, and each of said connecting protrusions protrude in a direction parallel to a longitudinal direction of said male-side metallic shield and said male connector portion; and a cylindrical a terminal accommodation space, within said inner housing, for accommodating terminals therewithin;

a female connector portion comprising:

an elongated annular female connector housing including an inner housing and an outer housing, wherein said inner and outer housings of said female connector housing are also of an elongated annular shape and said inner and outer housings of said female connector housing are connected to each other by a plurality of connecting portion so that said inner housing, said outer housing, and said connecting portions of said female connector housing form an integral one-piece body, an elongated annular female-side metallic shield for draining noises from a portion of said shielded electric wire housed within said-female connector housing, wherein said female-side metallic shield has first and second ends;

a female-side shield insertion space for housing said female-side metallic shield therewithin, wherein said female-side shield insertion space is located between said inner and outer housings of said female connector housing, and wherein said female-side shield insertion space surrounds said plurality of connecting portions;

wherein said female-side metallic shield includes a plurality of connecting protrusions, each of said connecting protrusions being formed by notching a plurality of slits in a first end of said female-side metallic shield, so that said connecting protrusions alternate with said slits in a circumferential direction of said female-side metallic shield, and each of said connecting protrusions protrude in a direction parallel to a longitudinal direction of said female-side metallic shield and said female connector portion; and a cylindrical a terminal accommodation space, within said inner housing, for accommodating terminals therewithin; and wherein said male connector portion is inserted into said female connector portion to form said sealed connector having said shielded electric wires sealed therewithin by said sealing means, said sealed connector having a two-piece outer housing comprised of said outer housing of said male connector portion and said outer housing of said female connector portion and a two-piece inner housing comprised of said inner housing of said male connector portion and said inner housing of said female connector portion such that said two-piece outer housing of said sealed connector surrounds said two-piece inner housing of said sealed connector and a two-piece metallic shield comprised of said metallic shield of said male connector portion and said metallic shield of said female connector portion is located between said two-piece inner housing of said sealed connector and said two-piece outer housing of said sealed connector.

2. The sealed connector according to claim 1, wherein each of said connecting protrusions of said male-side metallic shield of said male connector portion and each of said connecting protrusions of said female-side metallic shield of said female connector portion each include an engaging piece such that each engaging piece of each of said connecting protrusions is opposite of an engaging slot portion of said inner housing of said male connector portion and an engaging slot portion of said inner housing of said female connector portion, wherein a proximal end portion of each of said slits of said male-side metallic shield contacts one of said connecting portions of said male connector housing and a proximal end portion of each of said slits of said female-side metallic shield contacts one of said connecting portions of said female connector housing.

3. The sealed connector according to claim 1, wherein each of said connecting protrusions of said female-side metallic shield of said female connector portion contacts outer peripheries of adjacent ones of said connecting protrusions of said male-side metallic shield of said male connector portion to cover said slit between said adjacent ones of said connecting protrusions when said male connector portion is fitted into said female connector portion.

4. The sealed connector according to claim 3, wherein said male-side shield insertion space of said male connector portion and said female-side shield insertion space of said female connector portion are shifted by a phase angle in a circumferential direction of said male and female connector portions with respect to each other so that each of said connecting protrusions of said female-side metallic shield of said female connector portion contacts said outer peripheries of said adjacent ones of said connecting protrusions of said male-side metallic shield of said male connector portion to cover said slit between said adjacent ones of said connecting protrusions.

* * * * *

UNITED STATES PATENT AND TRADEMARK OFFICE

CERTIFICATE OF CORRECTION

PATENT NO.: 5,823,824
DATED : Oct. 20, 1998
INVENTOR(S): Mitamura et al.

It is certified that error appears in the above-identified patent and that said Letters Patent is hereby corrected as shown below:

ON THE TITLE PAGE:

add the following co-assignee:

Item --[73] Nissan Motor Co., Ltd., Kanagawa, Japan --.

Signed and Sealed this

Fifth Day of October, 1999

*Attest:*

Q. TODD DICKINSON

*Attesting Officer*

*Acting Commissioner of Patents and Trademarks*